US008951401B2

(12) United States Patent
Nishikiori et al.

(10) Patent No.: US 8,951,401 B2
(45) Date of Patent: Feb. 10, 2015

(54) METHOD FOR ELECTROCHEMICALLY DEPOSITING CARBON FILM ON A SUBSTRATE

(75) Inventors: Tokujiro Nishikiori, Kyoto (JP); Hiroaki Amahashi, Fukuchiyama (JP); Kouji Kuroda, Fukuchiyama (JP); Yasuhiko Ito, Kyotanabe (JP); Naohiro Yasuda, Yokkaichi (JP)

(73) Assignees: Toyota Boshoku Kabushiki Kaisha, Aichi (JP); I'msep Co., Ltd., Kyoto (JP); Sec Carbon, Limited, Hogyo (JP); The Doshisha, Kyoto (JP)

( * ) Notice: Subject to any disclaimer, the term of this patent is extended or adjusted under 35 U.S.C. 154(b) by 952 days.

(21) Appl. No.: 12/789,848

(22) Filed: May 28, 2010

(65) Prior Publication Data

US 2011/0290655 A1 Dec. 1, 2011

(51) Int. Cl.
*C25D 3/66* (2006.01)
*C25D 9/04* (2006.01)

(52) U.S. Cl.
CPC ... *C25D 3/66* (2013.01); *C25D 9/04* (2013.01)
USPC ..... 205/230; 205/316

(58) Field of Classification Search
USPC ..... 205/230
See application file for complete search history.

(56) References Cited

U.S. PATENT DOCUMENTS 3,607,413 A * 9/1971 Buzzelli ..... 205/231
4,738,759 A * 4/1988 Bienvenu et al. ..... 205/354
4,790,917 A * 12/1988 Dewing ..... 205/705
5,131,988 A * 7/1992 Peterson ..... 205/557
6,214,194 B1 * 4/2001 Isenberg ..... 205/230
2008/0311345 A1 * 12/2008 Ruuttu et al. ..... 428/138

FOREIGN PATENT DOCUMENTS

| | | |
|---|---|---|
| JP | 06-088291 | 3/1994 |
| JP | 2003-027214 | 1/2003 |
| JP | 2004-217975 | 8/2004 |
| JP | 2006-169554 | 6/2006 |

OTHER PUBLICATIONS

"Electrochemical and Chemical Reactivity of Carbon Electrodeposited from Cryolitic Melts Containing Aluminum Carbide" by Odegard et al., J. Electrochem. Soc. 138(9), pp. 2612-2617 (1991).*

"Physical Property Data Compilations Relevant to Energy Storage" by Janz et al., NSRDS-NBS 61, Part I (1978).*

"Synthesis of Nitrogenated Carbon Films by Cathodic Electrodeposition at the Solid-Liquid Interface" by Fu et al., Mater. Lett. 42, pp. 166-170 (2000).*

"Molten Salt-Based Growth of Bulk GaN and InN for Substrates" by Waldrip, Sandia Report, SAND2007-5210 (Aug. 2007).*

(Continued)

*Primary Examiner* — Bryan D. Ripa
(74) *Attorney, Agent, or Firm* — Greenblum & Bernstein, P.L.C.

(57) ABSTRACT

Dense carbon films are deposited on a conductive substrate by placing the substrate acting as anode in a molten salt electrolyte bath containing a source of carbide ion and applying DC current across the substrate and a counter electrode acting as cathode also placed in the molten salt electrolyte bath. The carbide ions are electrochemically oxidized to deposit a carbon film on the surface of the substrate.

14 Claims, 2 Drawing Sheets

(56) References Cited

OTHER PUBLICATIONS

"On the Solubility of Aluminum Carbide and Electrodeposition of Carbon in Cryolitic Melts" by Odegard et al., J. Electrochem. Soc. 134(5), pp. 1088-1092 (1987).*

Oishi et al., "Formation of Carbon Nitride by Anode-Discharge Electrolysis of Molten Salt" J. Electrochem. Soc. 149(11), pp. D178-D181 (2002).*

U.S. Appl. No. 12/789,959 to Tokujiro Nishikiori et al., filed May 28, 2010.

Shimada et al., "Cathodic Reduction of Carbonate Ion in LiCl-KCl Melt I. Electrodeposition of Carbon," Denki Kagaku, vol. 59, No. 8, pp. 701-706, 1991.

Kawamura et al., "Electrodeposition of Cohesive Carbon Films on Aluminum in a LiCl-KCl-$K_2CO_3$ Melt," Journal of Applied Electrochemistry, vol. 30, pp. 571-574, 2000.

* cited by examiner

METHOD FOR ELECTROCHEMICALLY DEPOSITING CARBON FILM ON A SUBSTRATE

FIELD OF THE INVENTION

The present invention relates to a method for electrochemically depositing carbon films on a conductive substrate using a molten salt electrolyte bath.

BACKGROUND ART

Carbon coatings are applied on metal substrates to impart the substrate with surfaces having unique properties such as low friction coefficient, high corrosion resistance and high electroconductivity. Carbon coating films can be deposited electrochemically on a conductive substrate. A method for electrochemically depositing such carbon films is disclosed in H. Kawamura and Y. Ito, Journal of Applied Electrochemistry, 30:571 (2000). The method comprises electrochemically reducing carbonate ion ($CO_3^{2-}$) into elementary carbon to be deposited on the surface of a substrate acting as cathode in a molten salt electrolyte bath containing carbonate ion.

This method is advantageous compared with other known methods such as chemical vapor deposition (CVD) or physical vapor deposition (PVD) in many respects including, for example, high throwing power comparable to electrolytic metal plating, simple operation and no need of complicated apparatus. However, the method tends to produce a carbon coating film which is not dense and consisted of porous aggregate of carbon particles.

A need exists, therefore, for a novel method for electrochemically depositing carbon films on a conductive substrate which can eliminate or ameliorate the defects of the known methods while retaining most of advantages thereof.

SUMMARY OF THE INVENTION

According to the present invention, the above need may be met by providing a method for electrochemically depositing a carbon film on a conductive substrate comprising the steps of:

- providing a molten salt electrolyte bath;
- dissolving a source of carbide ion in said molten salt electrolyte bath;
- placing said substrate and a counter electrode in said electrolyte bath, said substrate and said counter electrode being electrically connected to a DC current source and acting as anode and cathode, respectively; and
- applying DC current across said substrate and said counter electrode through said electrolyte bath whereby said carbide ion is electrochemically oxidized to deposit a carbon film on the surface of said substrate.

In a preferred embodiment, the carbide ion ($C_2^{2-}$) may be generated by adding calcium carbide $CaC_2$ into the molten salt electrolyte bath.

Preferably, the molten salt electrolyte bath may also contain nitride ion ($N^{3-}$) by adding, for example, lithium nitride $Li_3N$ into the bath. The addition of nitride ion is effective to deposit a homogeneous carbon film on the substrate.

The molten salt electrolyte bath used in the present invention preferably comprises an alkali metal halide, an alkaline earth metal halide, and mixtures thereof. Usually, binary or ternary mixtures of these halide salts are employed. Specific examples of mixtures of halide salts include a binary mixture of LiCl and KCl and a ternary mixture of LiCl, KCl and $CaCl_2$.

The bath temperature may vary depending upon the melting point of a specific electrolyte bath. The bath temperature ranges generally between 250° C. and 800° C., preferably between 350° C. and 700° C. when the above binary or ternary mixture is employed.

The method according to the present invention is capable of depositing very dense carbon films on the substrate in a simple manner using simple apparatus.

DETAILED DESCRIPTION OF THE INVENTION

Figure 1:
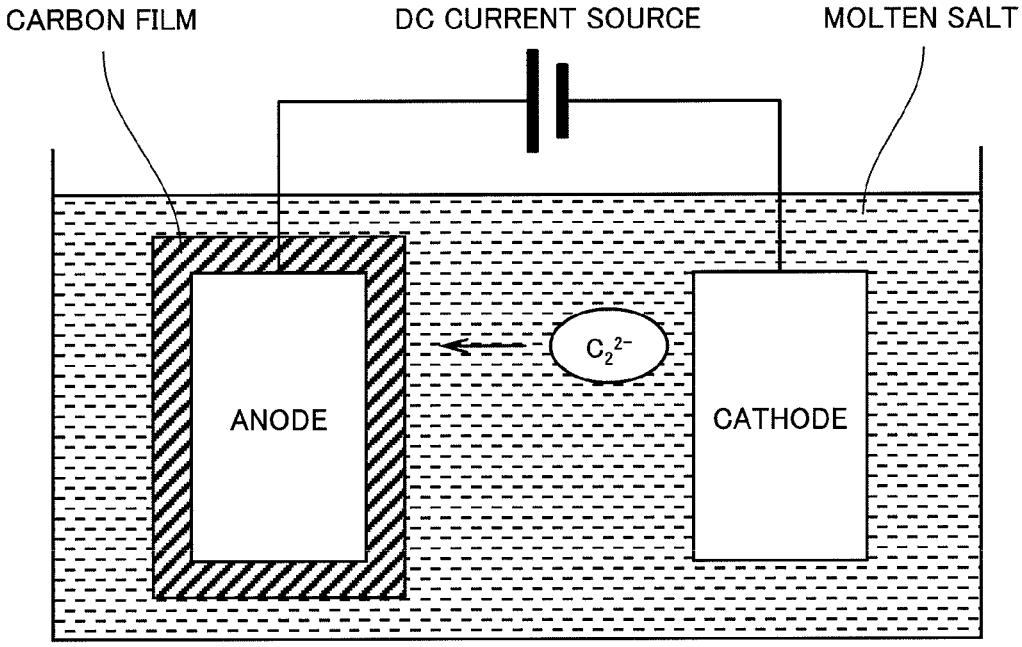
FIG. 1 schematically depicts the principle of the present invention.

FIG. 1 schematically depicts the principle of the present invention. As shown, a conductive substrate acting as anode and a counter electrode acting as cathode are placed in a molten salt electrolyte bath containing carbide ion. The substrate acting as anode and the counter electrode acting as cathode are connected to a DC current source and DC current is applied across the anode and cathode through the electrolyte bath. Carbide ion is anodically oxidized to deposit a carbon film on the surface of the substrate.

A molten salt electrolyte bath used in the present invention preferably comprises an alkali metal halide, an alkaline earth metal halide or a mixture of these halides.

The alkali metal halides include the fluoride, chloride, bromide and iodide of lithium, sodium, potassium, rubidium and cesium.

The alkaline earth metal halides include the fluoride, chloride, bromide and iodide of magnesium, calcium, strontium, and barium.

As a mixture of alkali metal halides and a mixture of alkaline earth metal halides, a binary mixture of LiCl and KCl and a ternary mixture of LiCl, KCl and $CaCl_2$ are especially preferred in view of the productivity and quality of resulting carbon films. In case of binary mixture of LiCl and KCl, the molar ratio of LiCl:KCl generally ranges between 30%:70% and 100%:0%, preferably between 55%:45% and 65%:35%. A eutectic mixture consisting of 58.5 mol % of LiCl and 41.5 mol % of KCl may also be used.

The molten salt electrolyte bath must contain a source of carbide ion as the reactant species. Any carbide compound capable of ionizing into carbide ion in the molten salt electrolyte bath may be employed. Calcium carbide $CaC_2$ is especially preferred as the source of carbide ion. Calcium carbide reaches saturation at a concentration of about 3 mol % in the eutectic mixture of LiCl and KCl at about 500° C.

In case of ternary mixture of LiCl, KCl and $CaCl_2$, a portion of LiCl or KCl or both in the above eutectic mixture may be replaced by $CaCl_2$. The molar proportions of LiCl, KCl and $CaCl_2$ are generally 0-80 mol % for LiCl, 5-80 mol % for KCl and 0.5-60 mol % for $CaCl_2$. The solubility of calcium carbide in the above ternary mixture varies depending upon the specific proportions and generally reaches saturation at about 5-7% at about 500° C.

The molten salt electrolyte bath may comprise an additive which may improve the quality of the resulting carbon film. An example of such additives is a nitride ion source such as $Li_3N$ which generates nitride ion in the bath. The addition of nitride ion to the bath is effective to deposit a homogeneous carbon film on the substrate.

It is preferable to carry out the electrolysis process in an inert gas atmosphere to prevent oxidation or otherwise deterioration of the deposited carbon film at an elevated temperature. It is also preferable to carry out the electrolysis process while stirring or otherwise agitating the electrolyte bath to produce dense carbon films and/or to accelerate the deposition rate of carbon films.

The bath temperature is kept higher than the melting point of electrolyte. Because the solubility of carbide ion source increases as the bath temperature elevates, it is possible to produce carbon films with uniform quality and/or to accelerate the deposition rate by elevating the bath temperature. On the other hand, the bath temperature is restricted in practice by several factors including the material of electrolyte vessel, handling problems and so on. Therefore, the bath temperature generally ranges between 250° C. and 800° C. and preferably ranges between 350° C. and 700° C.

According to the present invention, a substrate on which carbon film is to be deposited acts as anode. The substrate requires, therefore, to be made of an electroconductive material, typically metals. However, a substrate made of electroconductive materials may be employed provided that they are refractory to the molten salt bath. Because of high throwing power, the shape or contour of the substrate is not limited.

The counter electrode acting as cathode in the present invention may be any conventional electrode used in the molten salt electrolysis which is made of metals, carbonaceous materials and other conductive materials.

As will be appreciated, an electrochemical reaction takes place also on the surface of counter electrode. In case of LiCl/KCl mixed molten salt bath, lithium ion is reduced into lithium metal as follows.

$$Li^+ + e^- \rightarrow Li$$

As the lithium metal is in liquid phase in this case, there exists a risk of short circuit between the cathode and the anode. As an approach to avoid such risk, a cathode made of aluminum may be used to immobilize lithium as an alloy with aluminum. Another approach is to use liquid tin metal cathode so as to trap and recover lithium metal as Li/Sn liquid alloy.

It is imperative to carry out the electrolytic reaction within a potential range capable of electrochemically oxidizing the carbide ion for depositing of the carbon film on the substrate. In the LiCl/KCl mixed molten salt bath, the electrochemical oxidation of carbide ion occurs at about 1.0 V or higher (vs. $Li^+$/Li). When a metal substrate is used as anode, it is necessary to prevent the metal substrate from being anodically dissolved in the molten salt bath as the metal ions. Accordingly, it is preferable to carry out the electrolytic reaction at a potential within the range between about 1.0V and about 3.0V. The more negative within this range the more preferable.

After the reaction, the substrate is taken out from the molten salt bath and then washed to remove adhered electrolyte salt. Any washing method used for washing workpiece treated in the molten salt bath may be employed. For example, the substrate may be washed with deoxygenated warm water. The washing process may be carried out in an atmosphere of inert gas or hydrogen gas.

EXAMPLES

The following examples are offered without intending to limit the present invention thereto. Throughout the examples, a molten salt bath consisting of 58.5 mol % of LiCl and 41.5 mol % of KCl was used. The concentration of calcium carbide in the bath was adjusted to 3 mol % in all examples. As a substrate acting as anode, a nickel plate was used in all examples.

Example 1

Using the apparatus as schematically shown in FIG. 1, a carbon coating film was deposited on the substrate in the molten salt bath containing 3 mol % of calcium carbide dissolved therein at 500° C. at a constant potential of 1.5 V (vs. $Li^+$/Li). DC current was applied until a quantity of electricity reached 40 C/cm$^2$.

Figure 2A:
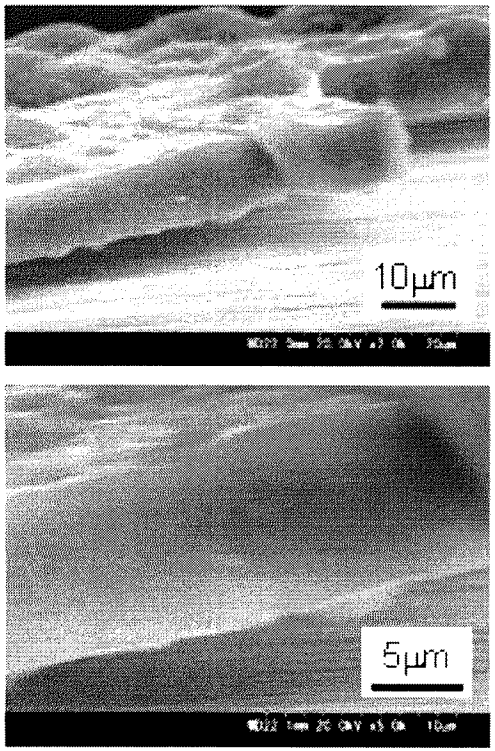
FIGS. 2A-2C show the scanning electron microscopic pictures of the carbon films produced in Examples taken in broken section.

X-ray diffraction analysis revealed that the carbon film consisted mainly of amorphous carbon including graphite-like carbon. In another test, the carbon film was forced to be broken down by folding the carbon film together with the metal substrate outwardly. Then the exposed broken section was examined by the scanning electron microscopy. As shown in FIG. 2A, the deposited carbon film was very dense as observed in the broken section.

Example 2

Figure 2B:
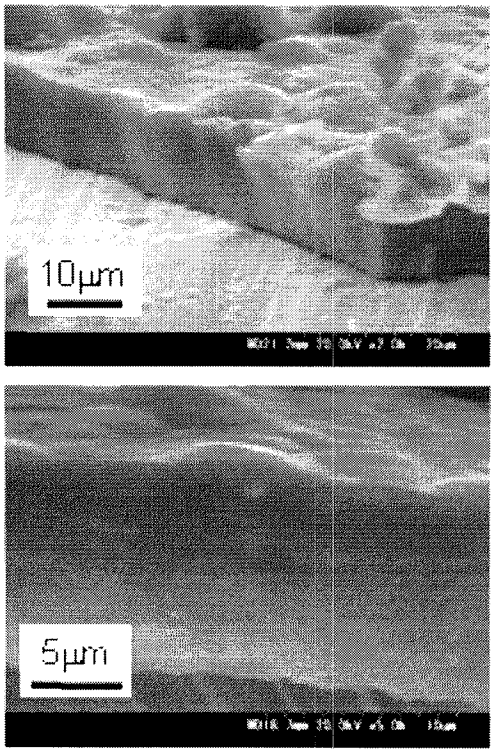

Example 1 was repeated except that lithium nitride $Li_3N$ was added to the molten salt bath at a concentration of 0.5 mol %. The deposited carbon film was broken down as in Example 1 and the broken section was examined by the scanning electron microscopy. As shown in FIG. 2B, the deposited carbon film was very dense as observed in the broken section and remained adhered integrally with the substrate.

Example 3

Figure 2C:
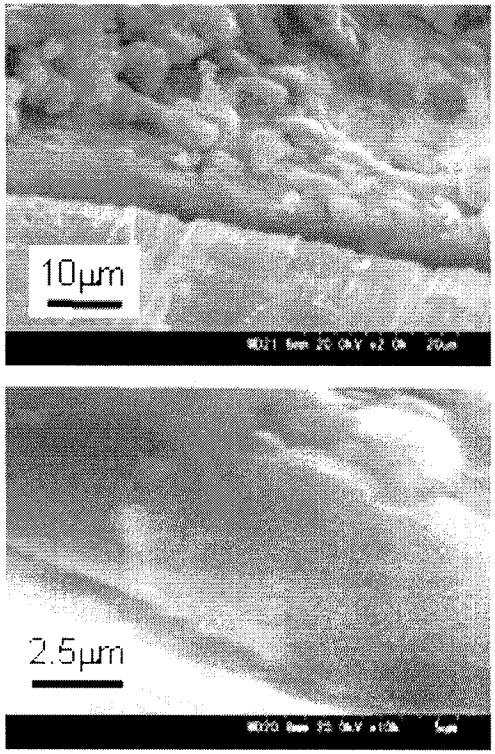

Example 1 was repeated except that lithium nitride $Li_3N$ was added to the molten salt bath at a concentration of 1.5 mol %. The deposited carbon film was broken down as in Example 1 and the broken section was examined by the scanning electron microscopy. As shown in FIG. 2C, the deposited carbon film was very dense as observed in the broken section and remained adhered integrally with the substrate. This demonstrates that the addition of lithium nitride improves the quality of the carbon film by the addition of lithium nitride at least up to 1.5 mol %.

The invention claimed is:

1. A method for electrochemically depositing a carbon film on a conductive substrate comprising:

providing a molten salt electrolyte bath selected from the group consisting of: a binary mixture of lithium chloride and potassium chloride, and a ternary mixture of lithium chloride, potassium chloride and calcium chloride;

dissolving calcium carbide as a source of carbide ion in said molten salt electrolyte bath;

placing said conductive substrate and a counter electrode in said electrolyte bath, said conductive substrate being made of metals, said substrate and said counter electrode being electrically connected to a DC current source and acting as anode and cathode, respectively; and applying DC current across said substrate and said counter electrode through said electrolyte bath whereby said carbide ion is electrochemically oxidized to deposit a carbon film on the surface of said substrate.

2. The method according to claim 1 wherein the DC current is applied at a potential capable of anodically oxidizing said carbide ion.

3. The method according to claim 1 wherein said DC current is applied at a potential in the range between 1.0 V and 3.0 V (vs. Li+/Li).

4. The method according to claim 1 wherein said molten salt electrolyte bath further contains a source of nitride ion dissolved therein.

5. The method according to claim 4 wherein said nitride ion source is lithium nitride.

6. The method according to claim 1 wherein said counter electrode is made of a metal capable of forming an alloy with lithium metal.

7. The method according to claim 6 wherein said metal is aluminum.

8. The method according to claim 1 wherein said molten salt electrolyte bath further contains a metal species capable of forming a liquid phase alloy with lithium at the temperature of said molten salt electrolyte bath.

9. The method according to claim 8 wherein said metal species is tin.

10. The method according to claim 1 wherein said molten salt electrolyte bath temperature ranges between 250° C. and 800° C.

11. The method according to claim 10 wherein said molten salt electrolyte bath temperature ranges between 350° C. and 700° C.

12. The method according to claim 1 wherein said binary mixture comprises 55 to 65 mol % of lithium chloride and 45 to 35 mol % of potassium chloride.

13. The method according to claim 1 wherein said binary mixture is a eutectic mixture of lithium chloride and potassium chloride.

14. The method according to claim 1 wherein DC current is applied to said substrate until a quantity of electricity of about 40 $C/cm^2$ is applied to said substrate.

* * * * *